United States Patent [19]

Chan et al.

[11] Patent Number: 4,538,627

[45] Date of Patent: Sep. 3, 1985

[54] SMOKING COMPOSITIONS CONTAINING A β-HYDROXY-γ-KETOESTER FLAVORANT-RELEASE ADDITIVE

[75] Inventors: W. Geoffrey Chan; Yoram Houminer, both of Richmond, Va.

[73] Assignee: Philip Morris Incorporated, New York, N.Y.

[21] Appl. No.: 664,821

[22] Filed: Oct. 25, 1984

[51] Int. Cl.[3] ..... A24B 3/12; A24B 15/30

[52] U.S. Cl. ..... 131/276

[58] Field of Search ..... 131/276; 560/53, 121, 560/126, 145, 174; 260/410, 398, 410.5, 410.9 R

[56] References Cited

U.S. PATENT DOCUMENTS 3,057,914 10/1962 Kitchens et al. ..... 560/174

4,441,514 4/1984 Mitchell et al. ..... 131/276

FOREIGN PATENT DOCUMENTS 0064326 12/1982 European Pat. Off. ..... 131/276

*Primary Examiner*—Y. Harris Smith

[57] ABSTRACT

This invention provides smoking compositions which contain a β-hydroxy-γ-ketoester compound as a flavorant-release additive.

In one of its embodiments, this invention provides tobacco compositions which contain a flavorant-release additive such as dodecyl 3-hydroxy-2,2,3-trimethyl-4-oxopentanoate:

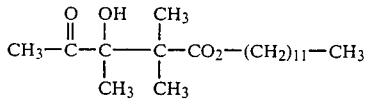

Under cigarette smoking conditions the above illustrated β-hydroxy-γ-keto ester pyrolyzes into 2,3-butanedione and other products which enhance the flavor of the mainstream smoke and the aroma of sidestream smoke.

11 Claims, No Drawings

SMOKING COMPOSITIONS CONTAINING A β-HYDROXY-γ-KETOESTER FLAVORANT-RELEASE ADDITIVE

BACKGROUND OF THE INVENTION

A variety of flavorants have been developed and proposed for incorporation into tobacco products. Illustrative of such tobacco flavorants are those described in U.S. Pat. Nos. 3,580,259; 3,625,224; 3,722,516; 3,750,674; 3,879,425; 3,881,025; 3,884,247; 3,890,981; 3,903,900; 3,914,451; 3,915,175; 3,920,027; 3,924,644; 3,937,228; 3,943,943; 3,586,387; 4,379,754; and the like.

U.S. Pat. No. 4,036,237 describes smoking compositions which contain an aromatic beta-hydroxy ester flavorant such as ethyl 2,2-dimethyl-3-hydroxy-3-phenylpropionate, which volatilizes under smoking conditions.

U.S. Pat. No. 4,312,368 describes smoking compositions which contain a heterocyclic-hydroxy-substituted carboxylate flavorant-release additive such as ethyl 2-(2-butyl)-3-hydroxy-3-methyl-3-(3-pyridyl)propionate. Under smoking conditions this additive pyrolyzes into 3-acetylpyridine and ethyl β-methylvalerate flavorants.

J. C. Leffingwell et al "Tobacco Flavoring For Smoking Products" (R. J. Reynolds publication, 1972) includes 1,2-diketone compounds in a listing of desirable flavorants for smoking compositions. Aliphatic 1,2-diketones such as 2,3-butanedione, 2,3-pentanedione, 2,3-hexanedione and 2,3-heptanedione are described as having a buttery, nutty aroma.

Other 1,2-diketones such as 1-phenyl-1,2-propanedione have a sweet balsamic aroma. U.S. Pat. No. 3,903,900 discloses cyclic 1,2-diketone tobacco flavorants such as 3-methyl-1,2-cyclopentanedione which has a strong caramel-spicy aroma.

A difficulty encountered with 1,2-diketone type of tobacco flavorants is the problem of a relatively low boiling point, which results in flavorant evaporation loss on prolonged storage of the flavored tobacco compositions. Thus, 2,3-butanedione as a component of tobacco smoke is characterized by a distinct buttery sweet taste and a desirable smoothing effect in smoke. However, a boiling point of 88° C. precludes the utility of this 1,2-diketone as a tobacco composition flavorant because of evaporation loss.

There is continuing research effort to develop improved low delivery smoking compositions which generate mainstream smoke with flavorant-enhanced taste and character under smoking conditions.

Accordingly, it is an object of this invention to provide smoking compositions having incorporated therein a flavorant component which is characterized by lack of mobility and/or volatility at ambient temperature.

It is another object of this invention to provide smoking tobacco compositions having incorporated therein a flavorant-release composition which under normal smoking conditions imparts improved flavor to mainstream smoke and improved aroma to sidestream smoke.

It is a further object of this invention to provide novel β-hydroxy-γ-ketoester compositions which are adapted to be incorporated into tobacco compositions, and which under normal smoking condititons release a 1,2-diketone type of volatile flavorant into cigarette smoke.

Other objects and advantages of the present invention shall become apparent from the following description and examples.

DESCRIPTION OF THE INVENTION

One or more objects of the present invention are accomplished by the provision of a smoking composition comprising an admixture of (1) combustible filler selected from natural tobacco, reconstituted tobacco and tobacco substitutes, and (2) between about 0.0001 and 2 weight percent, based on the total weight of filler, of a β-hydroxy-γ-ketoester flavorant-release additive corresponding to the formula:

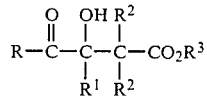

where R and $R^1$ are substituents selected from aliphatic, alicyclic and aromatic radicals containing between about 1–12 carbon atoms, and R and $R^1$ when taken together with connecting elements form an alicyclic structure; each of $R^2$ may be the same or different and is a substituent selected from the group consisting of hydrogen, and aliphatic, alicyclic and aromatic groups containing between about 1–16 carbon atoms; $R^3$ is a substituent selected from aliphatic, alicyclic and aromatic radicals containing between about 1–16 carbon atoms; and at least one of $R^2$ and $R^3$ is a substituent containing between about 5–16 carbon atoms.

In the ester formula represented above, the R or $R^1$ substituent is one containing between about 1–12 carbon atoms, preferably between about 1–10 carbon atoms, such as methyl, ethyl, propyl, methoxyethyl, butyl, isobutyl, pentyl, 2-hexyl, 5-hexenyl, cyclohexyl, cyclohexenyl, furfuryl, phenyl, tolyl, ethylphenyl, methoxyphenyl, ethoxyphenyl, hydroxyphenyl, and the like. In addition to carbon and hydrogen, the R substituent can contain heteroatoms such as oxygen, nitrogen and sulfur. When taken together with the connecting elements R and $R^1$ form an alicyclic structure such as cyclopentyl or cyclohexyl.

Illustrative of the $R^2$ substituents are hydrogen and alkyl groups such as methyl, ethyl, propyl, 2-butyl, hexyl, decyl and dodecyl, and other groups such as those listed above for R and $R^1$.

Illustrative of the $R^3$ substituent is an alkyl group containing between about 1–16 carbon atoms such as methyl, pentyl, decyl, dodecyl, pentadecyl and hexadecyl, and other groups such as those listed above for R and $R^1$ above.

When a present invention smoking composition is subjected to normal smoking conditions such as with cigarettes, the β-hydroxy-γ-ketoester additive decomposes to release a volatile 1,2-diketone flavorant component which contributes flavor-enhancing properties to the mainstream smoke:

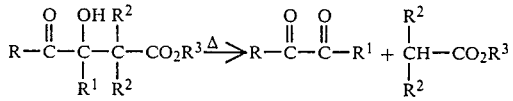

where R, $R^1$, $R^2$ and $R^3$ are as previously defined.

The ester pyrolysis component illustrated above can function as a flavorant if the component is sufficiently volatile after it is formed. The volatility of the ester will depend on the molecular weight of the ester as determined by the total carbon content of the $R^2$ and $R^3$ substituents. If it is preferred to have an ester pyrolysis component which is nonvolatile under smoking conditions, then at least one of the $R^2$ and $R^3$ substituents should contain between about 10–16 carbon atoms.

As demonstrated in Example VIII, a further advantage of providing a higher molecular weight β-hydroxy-γ-ketoester additive in a smoking composition is an increased flavorant-release efficiency. At a sufficiently high molecular weight, the β-hydroxy-γ-ketoester additive pyrolyzes and releases 1,2-diketone flavorant rather than the β-hydroxy-γ-ketoester additive volatilizing intact without thermolysis.

The present invention β-hydroxy-γ-ketoesters are easily prepared and purified, and are soluble in organic solvents. They are stable and odorless compounds at ambient temperatures. In addition, β-hydroxy-γ-ketoesters decompose at a relatively low pyrolysis temperature (e.g., 200°–300° C.) to release a high yield of desirable flavor-enhancing components in mainstream smoke. The β-hydroxy-γ-ketoesters are particularly effective for the efficient release of 1,2-diketone flavorants such as 2,3-butanedione and 1-phenyl-1,2-propanedione.

Preparation Of β-Hydroxy-γ-ketoesters

In another embodiment, the present invention provides a novel class of β-hydroxy-γ-ketoester compositions corresponding to the formula:

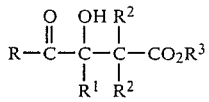

where R and $R^1$ are substituents selected from aliphatic, alicyclic and aromatic radicals containing between about 1–12 carbon atoms, and R and $R^1$ when taken together with connecting elements form an alicyclic structure; $R^2$ is hydrogen or a substituent selected from aliphatic, alicyclic and aromatic groups containing between about 1–16 carbon atoms; and $R^3$ is a substituent selected from aliphatic, alicyclic and aromatic radicals containing between about 1–16 carbon atoms.

The β-hydroxy-γ-ketoesters of the present invention can be prepared by reacting equivalent weights of a selected 1,2-diketone compound with an appropriate carboxylate ester compound in the presence of a strong base such as a metal amide. The reaction proceeds via a condensation of 1,2-diketone and carboxylate ester enolate anion:

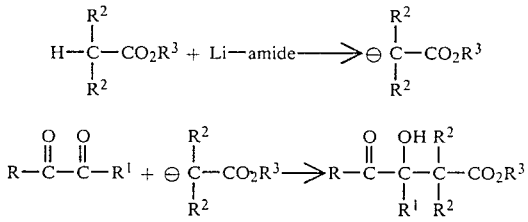

If the R and $R^1$ substituents are identical, then only one product is formed. As illustrated in Examples IV–V, two isomeric products are formed if the R and $R^1$ substituents are not identical groups. The isomeric products can be utilized as a mixture, or the two isomers can be separated by conventional procedures such as high pressure liquid chromatography.

If an alicyclic 1,2-ketone is a starting material for the synthesis of the β-hydroxy-γ-ketoester, then a modified synthesis route is employed. As illustrated in Example VII, the hydroxy group of the tautomeric hydroxyenone form of the alicyclic 1,2-diketone reactant first is protected with a trialkylsilyl group. The resultant intermediate then is condensed with the carboxylate ester enolate anion, followed by removal of the trialkylsilyl group to yield the desired β-hydroxy-γ-ketoester product.

Preparation Of Tobacco Compositions

In a further embodiment, the present invention provides a method of preparing a smoking composition which is adapted to impart improved taste and character to mainstream smoke under smoking conditions which method comprises incorporating into natural tobacco and/or reconstituted tobacco and/or tobacco substitute between about 0.0001 and 2 weight percent, based on composition weight, of a β-hydroxy-γ-ketoester flavorant-release additive corresponding to the formula:

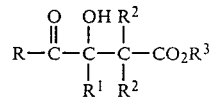

where R and $R^1$ are substituents selected from aliphatic, alicyclic and aromatic radicals containing between about 1–12 carbon atoms, and R and $R^1$ when taken together with connecting elements form an alicyclic structure; $R^2$ is hydrogen or a substituent selected from aliphatic, alicyclic and aromatic groups containing between about 1–16 carbon atoms; $R^3$ is a substituent selected from aliphatic, alicyclic and aromatic radicals containing between about 1–16 carbon atoms; and at least one of $R^2$ and $R^3$ is a substituent containing between about 5–16 carbon atoms.

The invention β-hydroxy-γ-ketoester flavorant-release additive can be incorporated into the tobacco in accordance with methods known and used in the art. Preferably the flavorant-release additive is dissolved in a solvent such as alcohol or aqueous alcohol and then sprayed or injected into the tobacco and/or tobacco substitute matrix. Such method ensures an even distribution of the flavorant additive throughout the filler, and thereby facilitates the production of a more uniform smoking composition. Alternatively, the flavorant may be incorporated as part of a concentrated tobacco extract which is applied to a fibrous tobacco web as in the manufacture of reconstituted tobacco. Another suitable procedure is to incorporate the flavorant in tobacco or tobacco substitute filler in a concentration between about 0.5–5 weight percent, based on the weight of filler, and then subsequently to blend the treated filler with filler which does not contain flavorant additive.

The term "tobacco substitute" is meant to include non-tobacco smoking filler materials such as are disclosed in U.S. Pat. Nos. 3,703,177; 3,796,222; 4,019,521; 4,079,742; and references cited therein, incorporated herein by reference.

U.S. Pat. No. 3,703,177 describes a process for preparing a non-tobacco smoking product from sugar beet pulp, which process involves the acid hydrolysis of the beet pulp to release beet pectins, and at least an alkaline earth treatment thereafter to cause crosslinking of the pectins and the formation of a binding agent for the exhausted beet matrix.

U.S. Pat. No. 3,796,222 describes a smoking product derived from coffee bean hulls. The hulls are treated with reagents that attack the alkaline earth metal crosslinks causing the release of the coffee pectins. The pectins act as a binding agent and together with the treated hulls may be handled and used similarly to a tobacco product.

U.S. Pat. No. 4,019,521 discloses a process for forming a smoking material which involves heating a cellulosic or carbohydrate material at a temperature of 150°-750° C. in an inert atmosphere for a period of time sufficient to effect a weight loss of at least 60 percent but not more than 90 percent.

U.S. Pat. No. 4,079,742 discloses a process for the manufacture of a synthetic smoking product from a cellulosic material, which process involves a pyrolysis step and a basic extraction step to yield a resultant matrix which has a tobacco-like brown color and has improved smoking characteristics.

The following Examples are further illustrative of the present invention. The specific ingredients and processing parameters are presented as being typical, and various modifications can be derived in view of the foregoing disclosure within the scope of the invention.

Examples I-VII illustrate the preparation of β-hydroxy-γ-ketoester compounds in accordance with the present invention. Infrared and nuclear magnetic resonance analyses are utilized to confirm the structure of each compound.

As demonstrated in Example IX, when a present invention β-hydroxy-γ-ketoester is incorporated into low delivery filtered cigarette tobacco filler, there is a detectable enhancement of flavor and body in the mainstream smoke as compared to control cigarettes not containing a β-hydroxy-γ-ketoester flavorant-release additive.

EXAMPLE I

Dodecyl 3-hydroxy-2,2,3-trimethyl-4-oxopentanoate

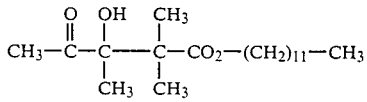

To a solution of diisopropylamine (5.56 g, 0.055 mole) in 200 ml of dry ether at 0° C. under nitrogen is added with stirring n-butyllithium (0.055 mole) in hexane (31 ml). The resulting mixture is cooled to −70° C., and a solution of dodecyl isobutyrate (12.8 g, 0.05 mole) in ether (25 ml) is added dropwise over a period of 20 minutes. The mixture is warmed to −15° C., and a solution of 2,3-butanedione (4.73 g, 0.055 mole) in ether (10 ml) is added rapidly. The mixture then is stirred at −5° C. for 15 minutes.

The reaction mixture is combined with 200 ml of saturated ammonium chloride solution, and the separated organic layer is washed in sequence with 200 ml of 0.5N HCl, 200 ml of saturated sodium bicarbonate, and 200 ml of saturated sodium chloride. The solution is dried over magnesium sulfate and the solvent is removed under reduced pressure to give 19 g of an oil. The oil is distilled in a Kugelrohr apparatus (air bath temperature 85°-115° C. at 0.1 mm Hg) to provide 13.5 g of almost pure product. Fractional distillation of the oil yields 11.5 g of pure product (67%), b.p. 132°-133° C. at 0.05 mm Hg.

IR and NMR data confirm the above structure.

Anal. calc. for $C_{20}H_{38}O_4$: C,70.13; H,11.18. Found: C,70.11; H,11.24.

EXAMPLE II

Hexadecyl 3-hydroxy-2,2,3-trimethyl-4-oxopentanoate

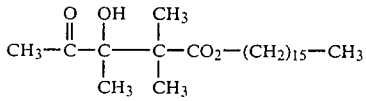

The reaction of hexadecyl isobutyrate (15.6 g, 0.05 mole) with 2,3-butanedione (4.73 g 0.055 mole) is conducted in the manner described in Example I. Low molecular weight impurities in the crude reaction mixture (19 g of oil) are removed by Kugelrohr distillation. The residual material (10 g) is combined with a distillation fraction (120°-150° C., at 0.01 mm Hg, 3.7 g) and the mixture is purified by high pressure liquid chromatography on silica gel using 10% ethyl acetate in hexane as the eluant, to yield 11.5 g (58%) of the desired product in pure form.

IR and NMR data confirm the above structure.

Anal. calc. for $C_{24}H_{46}O_4$: C,72,31; H,11.63. Found: C,72.50; H,11.56.

EXAMPLE III

Ethyl 2-(1-hydroxy-1-methyl-2-oxopropyl)-2-methylundecanoate

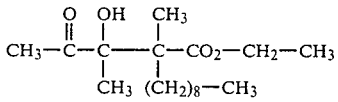

The reaction of ethyl 2-methylundecanoate (11.4 g, 0.05 mole) with 2,3-butanedione (4.73 g, 0.055 mole) is conducted in the manner described in Example I, and 16.6 g of a crude oil is obtained. The crude oil product is subjected to high pressure liquid chromatography on silica gel using 5% ethyl acetate in hexane as the eluant, yielding a pure product (9.2 g, 59%), b.p. 100° C. (Kugelrohr air bath temperature) at 0.01 mm Hg.

IR and NMR data confirm the above structure.

Anal. calc. for $C_{18}H_{34}O_4$: C,68.75; H,10.90. Found: C,68.91; H,10.72.

EXAMPLE IV

Dodecyl 3-hydroxy-2,2-dimethyl-4-oxo-3-phenylpentanoate and Dodecyl 3-hydroxy-2,2,3-trimethyl-4-oxo-4-phenylbutyrate

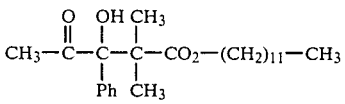

(IVa)

-continued

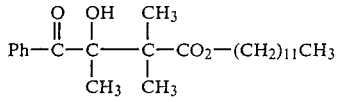

(IVb)

The reaction of dodecyl isobutyrate (6.4 g, 0.025 mole) with 1-phenyl-1,2-propanedione (3.7 g, 0.025 mole) is conducted in the manner described in Example I. Thin layer chromatography of the crude reaction mixture indicates the presence of two main reaction products. High pressure liquid chromatography on silica gel using 2% ethyl acetate in hexane as the eluant yields pure dodecyl 3-hydroxy-2,2-dimethyl-4-oxo-3-phenylpentanoate(IVa) (3.2 g, 32%), b.p. 148° C. (Kugelrohr air bath temperature) at 0.005 mm Hg. Also recovered is pure dodecyl 3-hydroxy-2,3,3-trimethyl-4-oxo-4-phenylbutyrate(IVb) (3.5 g, 35%), b.p. 145° C. (Kugelrohr air bath temperature) at 0.005 mm Hg.

IR and NMR data confirm the structures of the two products.

Anal. calc. for $C_{25}H_{40}O_5$(IVa): C,74.21; H,9.97. Found: C,74.45; H,9.98.

Anal. calc. for $C_{25}H_{40}O_5$(IVb): C,74.21; H,9.97. Found: C,74.40; H,9.85.

EXAMPLE V

Dodecyl 3-hydroxy-2,2,3-trimethyl-4-oxoheptanoate and Dodecyl 3-hydroxy-2,2-dimethyl-3-propyl-4-oxopentanoate

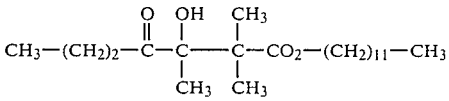

(Va)

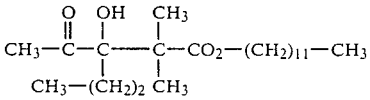

(Vb)

The reaction of dodecyl isobutyrate (12.8 g, 0.05 mole) with 2,3-hexanedione (5.7 g, 0.05 mole) is conducted in the manner described in Example I. Thin layer chromatography of the resultant crude oil (15.4 g) indicates the presence of two main products. A portion of the crude oil (4 g) is subjected to high pressure liquid chromatography as in Example IV to yield 2.2 g of pure dodecyl 3-hydroxy-2,2,3-trimethyl-4-oxoheptanoate (Va), b.p. 125°-128° C. (Kugelrohr air bath temperature) at 0.01 mm Hg, and 0.8 g of pure dodecyl 3-hydroxy-2,2-dimethyl-3-propyl-4-oxopentanoate(Vb), b.p. 125° C. at 0.01 mm Hg.

IR and NMR data confirm the structures of the two products.

The remaining crude oil is distilled in a Kugelrohr apparatus (125° C. at 0.01 mm Hg) to yield 10 g (total yield 70%) of a pure mixture of Va and Vb. The pure mixture is employed for thermolysis in Example VIII, and for elemental analysis.

Anal. calc. for $C_{22}H_{42}O_4$: C,71.30; H,11.43. Found: C,71.48; H,11.50.

EXAMPLE VI

Methyl 3-hydroxy-2,2,3-trimethyl-4-oxopentanoate

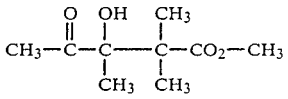

The reaction of methyl isobutyrate (5.61 g, 0.55 mole) with 2,3-butanedione (4.73 g, 0.055 mole) is conducted in the manner described in Example I. Distillation of the resultant crude product in a Kugelrohr apparatus yields 6.7 g (65%) of pure product, b.p. 40° C. (air bath temperature) at 0.01 mm Hg.

IR and NMR data confirm the above structure.

Anal. calc. for $C_9H_{16}O_4$: C,57.43; H,8.57. Found: C,57.23; H,8.70.

EXAMPLE VII

Dodecyl 2-(1-hydroxy-2-oxo-3-methylcyclopent-1-yl)-2,2-dimethylacetate

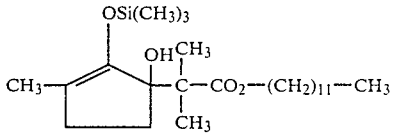

(VIIa)

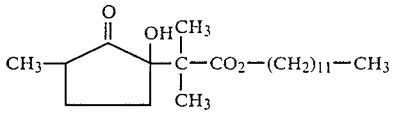

(VIIb)

To a solution of 3-methyl-1,2-cyclopentanedione (11.2 g, 0.1 mole) in acetonitrile (100 ml) is added with stirring 10.1 g of bis(trimethylsilyl)acetamide. The mixture is stirred at room temperature for 1 hour and then refluxed for 30 minutes. The solvent is removed on a rotary evaporator to provide a solution of about one fifth of the original volume. Hexane (100 ml) is added and the solution is warmed and stirred for 10 minutes, followed by the addition of another 50 ml of hexane. The solid that separates is filtered, and the filtrate is evaporated under reduced pressure down to a residual light yellow liquid. The material is distilled (Kugelrohr, 48° C. at 0.01 mm Hg) to yield 17.8 g (97%) of pure 3-methyl-2-trimethylsilyloxycyclopent-2-en-1-one.

The reaction of dodecyl isobutyrate (12.8 g, 0.05 mole) with the above silylated diketone (9.2 g, 0.05 mole) is conducted in the manner described in Example I, and produces 18.0 g of a crude oil. One gram of the crude oil is purified by high pressure liquid chromatography to yield 350 mg of pure dodecyl 2-(1-hydroxy-2-trimethylsilyloxy-3-methylcyclopent-2-en-1-yl)-2,2-dimethylacetate(VIIa).

IR and NMR data confirm the structure of compound (VIIa).

One gram of crude compound(VIIa) is dissolved in 7 ml of a 1M solution of n-$Bu_4NF$ in tetrahydrofuran. The solution is maintained at room temperature for one hour, at which time thin layer chromatography indicates complete hydrolysis. Water (10 ml) is added and the product is extracted with methylene chloride (2×10 ml). The combined organic layers are washed with water (10 ml) and saturated NaCl solution (20 ml). The solution is dried over $MgSO_4$ and the solvent is evaporated under reduced pressure to give 900 mg of crude oil. About 500 mg of the crude oil is purified by high pressure liquid chromatography to yield 250 mg of pure dodecyl 2-(1-hydroxy-2-oxo-3-methylcyclopent-1-yl)-2,2-dimethylacetate(VIIb).

NMR and IR data confirm the above structure.

EXAMPLE VIII

Pyrolysis Of β-hydroxy-γ-ketoesters

About 125 mg of a β-hydroxy-γ-ketoester substrate from the previous Examples is placed in a tube (5 mm i.d.). The tube is heated in an oil bath maintained at 250° C. for a period of time indicated in the Table. The upper part of the tube is kept cold by dry ice to avoid any loss of product by evaporation. The procedure is repeated for the substrates listed in the Table. Each sample is analyzed by gas chromatography and the amount of diketone obtained is determined. The results are summarized in the Table.

TABLE

| Example Substrate | Time, min. | %, 1,2-diketone |
|---|---|---|
| I[a] | 10 | 28 2,3-butanedione[a] |
| II | 10 | 24 2,3-butanedione |
| III | 7 | 74 2,3-butanedione |
| IV | 10 | 73 1-phenyl-1,2-propanedione |
| V | 10 | 44 2,3-hexanedione |
| VI[b] | 10 | trace 2,3-butanedione[b] |
| VIIb[c] | 10 | 10 3-methyl-1,2-cyclopentanedione[c] |

[a]Pyrolysis of I under a flow of helium at 300° C. for 1 minute yields 88% of 2,3-butanedione.

[b]At 250° C. most of the starting material distills unchanged. This demonstrates the advantage of a higher alkyl substituent in the substrate compound, since it decreases the volatility of the substrate and increases its efficiency as a release reagent.

[c]Pyrolysis of VIIb under a flow of helium at 350° C. for 1 minute yields 40% of 3-methyl-1,2-cyclopentanedione.

EXAMPLE IX

Commercial low delivery filter cigarettes are treated with the β-hydroxy-γ-ketoester[a] of Example II and with the β-hydroxy-γ-ketoester[b] of Example VII, respectively, by applying with a hypodermic syringe along the core of each cigarette an amount of ethanolic solution to provide 0.05% of the flavorant based on the weight of the tobacco. The cigarettes are conditioned to eliminate the solvent.

(a) Hexadecyl 3-hydroxy-2,2,3-trimethyl-4-oxopentanoate.

(b) Dodecyl 2-(1-hydroxy-2-oxo-3-methylcyclopent-1-yl)-2,2-dimethylacetate.

The treated cigarettes and control cigarettes are smoked by a panel of experienced smokers. The cigarettes containing the Example II β-hydroxy-γ-ketoester are found to have a slightly smoother, sweeter response than the control cigarettes. The cigarettes containing the Example VII β-hydroxy-γ-ketoester are found to have a smoother response than the control cigarettes.

What is claimed is:

1. A smoking composition comprising an admixture of (1) combustible filler selected from natural tobacco, reconstituted tobacco and tobacco substitutes, and (2) between about 0.0001 and 2 weight percent, based on the total weight of filler, of a β-hydroxy-γ-ketoester flavorant-release additive corresponding to the formula:

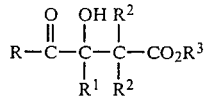

where R and $R^1$ are substituents selected from aliphatic, alicyclic and aromatic radicals containing between about 1–12 carbon atoms, and R and $R^1$ when taken together with connecting elements form an alicyclic structure; each of $R^2$ is hydrogen or a substituent selected from aliphatic, alicyclic and aromatic groups containing between about 1–16 carbon atoms; $R^3$ is a substituent selected from aliphatic, alicyclic and aromatic radicals containing between about 1–16 carbon atoms; and at least one of $R^2$ and $R^3$ is a substituent containing between about 5–16 carbon atoms.

2. A smoking composition in accordance with claim 1 wherein the tobacco substitutes are selected from pectinaceous cellulosic and other carbohydrate materials.

3. A smoking composition in accordance with claim 1 wherein the additive is dodecyl 3-hydroxy-2,2,3-trimethyl-4-oxopentanoate.

4. A smoking composition in accordance with claim 1 wherein the additive is hexadecyl 3-hydroxy-2,2,3-trimethyl-4-oxopentanoate.

5. A smoking composition in accordance with claim 1 wherein the additive is ethyl 2-(1-hydroxy-1-methyl-2-oxopropyl)-2-methylundecanoate.

6. A smoking composition in accordance with claim 1 wherein the additive is dodecyl 3-hydroxy-2,2-dimethyl-4-oxo-3-phenylpentanoate.

7. A smoking composition in accordance with claim 1 wherein the additive is dodecyl 3-hydroxy-2,2,3-trimethyl-4-oxo-4-phenylbutyrate.

8. A smoking composition in accordance with claim 1 wherein the additive is dodecyl 3-hydroxy-2,2,3-trimethyl-4-oxoheptanoate.

9. A smoking composition in accordance with claim 1 wherein the additive is dodecyl 3-hydroxy-2,2-dimethyl-3-propyl-4-oxopentanoate.

10. A smoking composition in accordance with claim 1 wherein the additive is dodecyl 2-(1-hydroxy-2-oxo-3-methylcyclopent-1-yl)-2,2-dimethylacetate.

11. A method of preparing a smoking composition which is adapted to impart flavoring to the mainstream and sidestream smoke under smoking conditions, which method comprises incorporating into natural tobacco, reconstituted tobacco or tobacco substitute between about 0.0001 and 2 weight percent, based on composition weight, of a β-hydroxy-γ-ketoester flavorant-release additive corresponding to the formula:

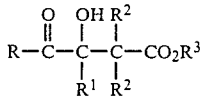

where R and $R^1$ are substituents selected from aliphatic, alicyclic and aromatic radicals containing between about 1–12 carbon atoms, and R and $R^1$ when taken together with connecting elements form an alicyclic structure; each of $R^2$ is hydrogen or a substituent selected from aliphatic, alicyclic and aromatic groups containing between about 1–16 carbon atoms; $R^3$ is a substituent selected from aliphatic, alicyclic and aromatic radicals containing between about 1–16 carbon atoms; and at least one of $R^2$ and $R^3$ is a substituent containing between about 5–16 carbon atoms.

* * * * *